United States Patent [19]

Corsette

[11] Patent Number: 4,506,809

[45] Date of Patent: Mar. 26, 1985

[54] DISPENSING FITMENT FOR SQUEEZE BOTTLES

[75] Inventor: Douglas F. Corsette, Los Angeles, Calif.

[73] Assignee: Calmar, Inc., City of Industry, Calif.

[21] Appl. No.: 392,327

[22] Filed: Jun. 25, 1982

[51] Int. Cl.[3] ..... B05B 11/04

[52] U.S. Cl. ..... 222/213; 222/494; 222/520; 222/525; 137/493

[58] Field of Search ..... 222/212, 213, 215, 491–497, 222/397, 402.24, 525, 522, 513, 153, 209, 511, 512, 514, 515, 519, 520; 137/493, 493.9; 239/327, 328, 570, 571

[56] References Cited

U.S. PATENT DOCUMENTS

| | | | |
|---|---|---|---|
| 2,679,946 | 6/1954 | Friend | 137/493.9 X |
| 3,401,845 | 9/1968 | Bach | 222/213 X |
| 3,648,903 | 3/1972 | Marchant | 222/212 |
| 3,794,247 | 2/1974 | Corsette | 239/327 |
| 3,843,028 | 10/1974 | Whitehead | 222/494 |
| 4,057,177 | 11/1977 | Laauwe | 222/493 X |
| 4,093,124 | 6/1978 | Morane et al. | 239/327 |
| 4,102,476 | 7/1978 | Loeffler | 222/209 |
| 4,408,702 | 10/1983 | Horvath | 222/496 X |

FOREIGN PATENT DOCUMENTS

| | | |
|---|---|---|
| 1349206 | 4/1974 | United Kingdom . |
| 1448427 | 9/1976 | United Kingdom . |

*Primary Examiner*—Joseph J. Rolla
*Assistant Examiner*—Kevin P. Shaver
*Attorney, Agent, or Firm*—Watson, Cole, Grindle & Watson

[57] ABSTRACT

A dispensing fitment for squeeze bottles includes a combined discharge and vent passage for establishing communication between the atmosphere and the interior of the bottle, the fitment defining a pair of oppositely facing, annular valve seats of different diameters, and further including an annular resilient diaphragm valve extending across the combined discharge and vent passage while being unattached to the fitment and normally being axially compressed against both valve seats for closing the passage. The valve is deflected to a discharge open position in which it is unseated from one of the valve seats when the pressure within the bottle exceeds atmospheric and the valve is deflected to a vent open position in which it is unseated from the other of the valve seats when the pressure within the bottle is reduced below atmospheric.

18 Claims, 12 Drawing Figures

DISPENSING FITMENT FOR SQUEEZE BOTTLES

RELATED APPLICATION

This application relates to U.S. Ser. No. 322,703 (O'-Neill), copending and commonly owned herewith, and now U.S. Pat. No. 4,420,101.

BACKGROUND OF THE INVENTION

This invention relates generally to squeeze bottles and a dispensing fitment therefor, and more particularly to a fitment having dual dispensing and venting functions.

Squeeze bottles for the dispensing of a wide range of products are well known in construction and operation. The bottles are generally of elastically deformable plastic throughout, or include a resiliently deformable wall portion, which when manually squeezed increases the pressure within the bottle and opens some type of discharge valve. During the recovery stroke each time the bottle is released and permitted to reexpand to its normal volume, the discharge valve closes and some form of vent valve opens to admit outside air into the bottle to replenish the amount of product dispensed. The dispensing and venting operations are typically carried out through separate passages having separate check valves or the like, or through the same passage with no valves. Such arrangements, however, require additional parts and molding operations which tend to not only affect the reliability of operation but increase the cost of assembly and manufacture.

The aforementioned related application is directed to a dispensing closure for a squeeze bottle having a combined product discharge and air vent passage controlled by a diaphragm valve which stretches in opposite directions in response to changes in pressure reacting on opposite sides during the bottle squeezing and release operations.

SUMMARY OF THE INVENTION

It is an object of the present invention to provide a dispensing fitment for squeeze bottles having a combined discharge and vent valve as including a resilient diaphragm in the form of a Belleville (spring) washer which opens and closes a combined discharge and vent passage without interference and immediately responds to increases and decreases in pressure within the bottle during manual squeeze and release operations, by resiliently flexing without stretching.

Another object of this invention is to provide such a dispensing fitment which includes a closure cap and a lid in engagement therewith, the spring washer being loosely disposed between the two members under axially opposing forces in a compressive direction acting at or adjacent the inner diameter and at the outer diameter of the valve which bears against oppositely facing, annular valve seats of different diameters. The diaphragm valve is disposed between the members with no radial restraint and therefore without any interference during its discharge open and vent open movements.

A further object of the present invention is to provide such a dispensing fitment wherein the valve extends across the combined discharge and vent passage for normally closing the passage upon equalization of pressure on opposite sides of the valve, is deflected into a discharge open position in which the washer is unseated from one of the valve seats when the pressure within the bottle exceeds atmospheric, and is deflected to a vent open position in which the valve is unseated from the other of the valve seats when the pressure within the bottle is reduced below atmospheric.

A still further object of this invention is to provide such a fitment in one embodiment wherein the cap and lid are relatively rotatable and have oppositely extending sleeves in telescoping engagement forming a central rotary spigot, the passage including bores provided in the sleeves which may be aligned and misaligned during relative rotary movement of the members for respectively opening and closing the passage during storage and shipment.

A still further object of the present invention is to provide such a fitment in another embodiment wherein the cap has a centrally projecting valve member defining a discharge valve seat surrounded by an oversized opening in the lid which may be closed by a removable adhesive shipping seal.

A still further object of the invention is to provide such a fitment in yet another embodiment in which the valve is locked-down by the lid in a shipping or storage position of non-use, and is held in compression between oppositely facing annular valve seats on the closure.

A still further object of the invention is to provide such a fitment in yet another embodiment wherein a discharge port end of the valve extends into an opening in the lid so that no product can drip within the lid but will always be confined outside the lid opening. Also the discharge port is purged after each use automatically.

Other objects, advantages and novel features of the invention will become more apparent from the following detailed description of the invention when taken in conjunction with the accompanying drawings.

DETAILED DESCRIPTION OF THE INVENTION

Figure 1:
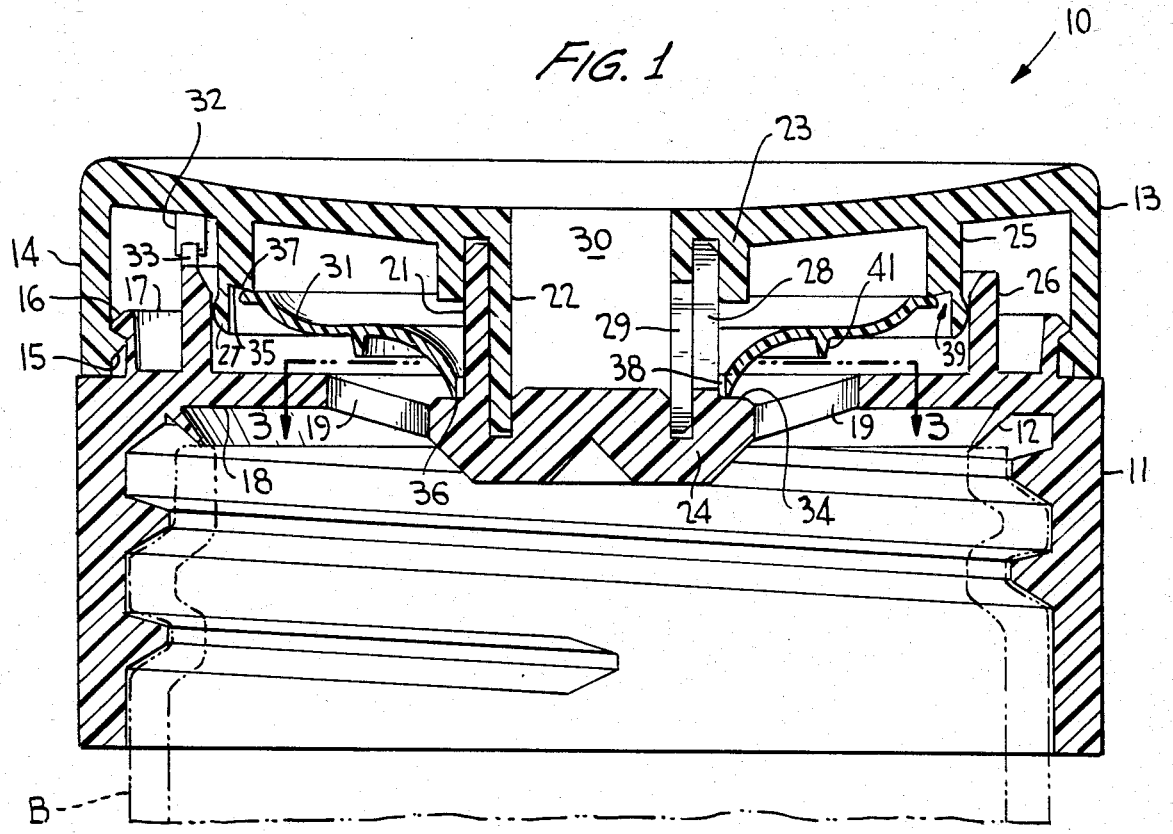
FIG. 1 is a vertical sectional view taken through the dispensing fitment according to one embodiment of the invention showing the valve in a normally closed position, the squeeze bottle being omitted for the sake of clarity.
Figure 2:
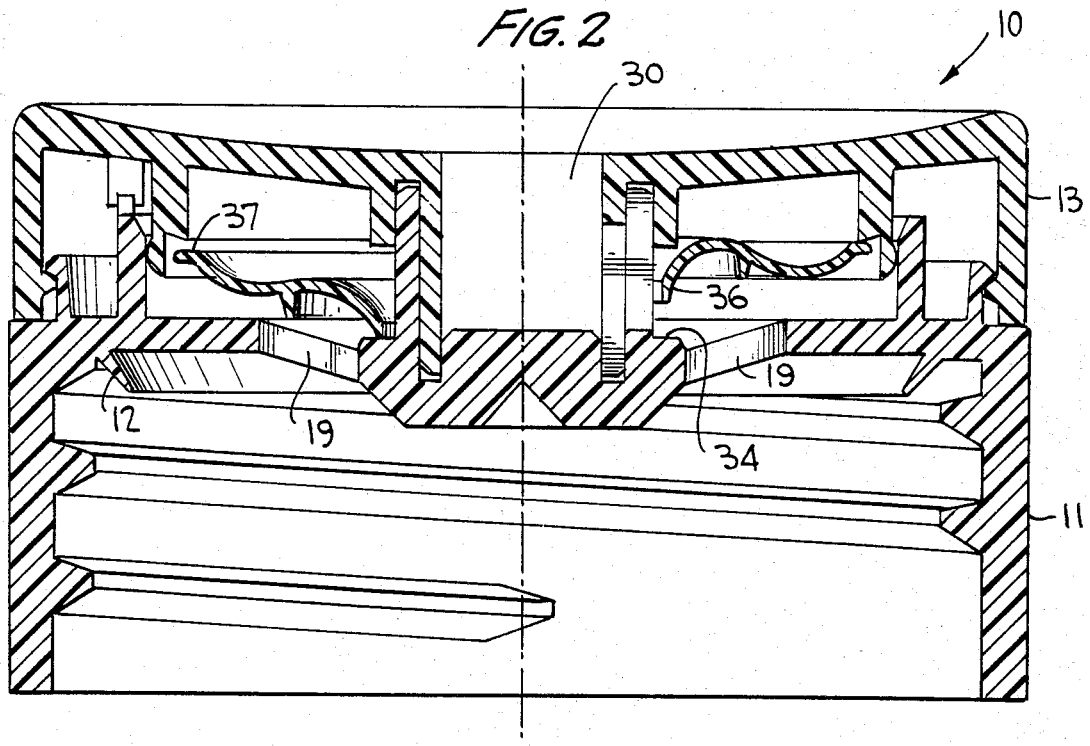
FIG. 2 is a view similar to FIG. 1 but showing the valve in a discharge open position to the right of the centerline and in a vent open position to the left of the centerline.

Turning now to the drawings wherein like reference characters refer to like and corresponding parts throughout the several views, the dispensing fitment according to a first embodiment of the invention is generally designated 10 in FIGS. 1 and 2 and includes an internally threaded closure cap 11 adapted for fluid tight engagement with the outer threads on the neck of a squeeze bottle B partially shown in phantom outline for containing a product to be dispensed. Such a squeeze bottle normally has a resiliently flexible wall or wall portion which may be alternately squeezed or indented to expel a portion of its contents and then released. The internal threads on the closure cap and the external threads on the bottled neck may, however, be eliminated and the cap may be adapted for insertion and press fitted within the neck opening of the squeeze bottle, or may be adapted for a snap fluid tight fit over the bottle neck, without departing from the invention. And, the cap is rendered fluid tight when in place by the provision of an integral seal member 12 for engagement on the top lip of the container neck.

The dispensing fitment further includes a lid 13 of generally circular configuration having an annular outer wall 14 with an inwardly extending lock rib 15 to facilitate a snap fit behind a mating lock rib 16 extending radially outwardly from a short skirt 17 on a closure wall 18 of the cap. The lid may therefore be rotated relative to the closure cap about the central axis thereof.

Figure 3:
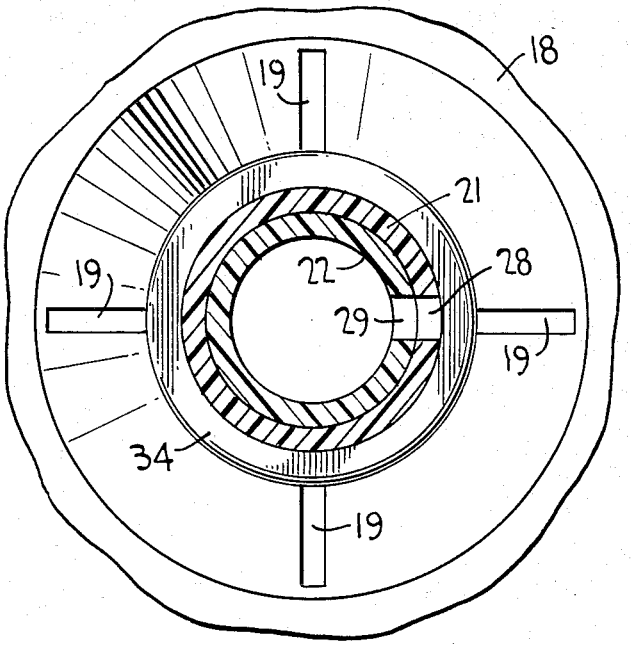
FIG. 3 is a view taken substantially along the line 3—3 of FIG. 1 but with the valve being omitted for the sake of clarity.
Figure 7A:
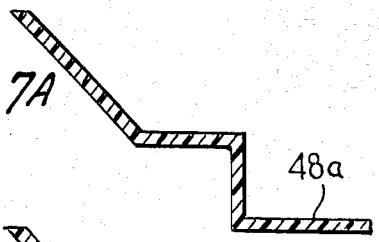
FIGS. 7A to 7F show examples of alternate valve-half shapes of the diaphragm valve in section.
Figure 7B:
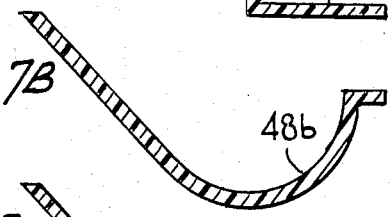
Figure 7C:
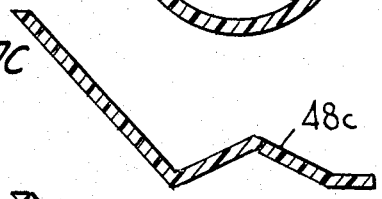
Figure 7D:
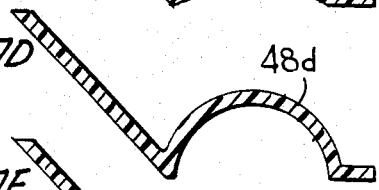
Figure 7E:
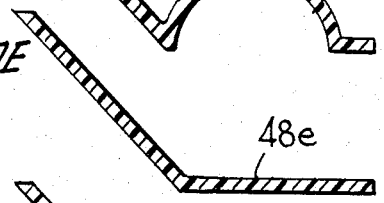
Figure 7F:
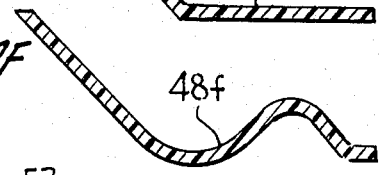

Wall 18 of the cap is provided with a number of bores 19 shown in FIG. 3 as rectangular in shape, although they may be of circular, oval or other shapes, and there may be fewer or more bores than shown, without departing from the invention. And, a central sleeve 21 extends outwardly of wall 18 for telescoping engagement with an inwardly extending central sleeve 22 provided on the lid. The sleeves respectively extend into opposing annular grooves 23 and 24 provided in the lid and cap to effect a fluid tight seal between the members. And, inner annular walls 25 and 26 extend toward one another respectively from the lid and the cap, an annular bead 27 on wall 25 tightly engaging an inner surface of wall 26 to further effect a fluid tight seal between the members.

Cutout openings 28 and 29 are respectively provided in mating sleeves 21 and 22 for establishing, when in alignment as shown in FIG. 3, communication between a central bore 30 in the lid, and the interior of the bottle through one or more bores 19 via an open diaphragm valve 31 to be described in more detail hereinafter. A fluid passage is thereby established through which, as will be seen, both product is dispensed from the container and the interior of the container is vented during manual manipulation of the squeeze bottle. And, upon relative rotary movement of the lid and cap until cutout openings 28 and 29 are fully misaligned, the passage is sealed closed during non-use conditions of storage and shipping. A central rotary spigot shipping and storage seal is thus formed by telescoping sleeves 21 and 22. And stop means in the form of cooperating lugs 32 and 33 cooperating between the lid and cap, which are known in the art, may be provided for limiting relative rotary movements in both the aligned position of openings 28 and 29 and in the misaligned position of the openings.

A flat annular valve seat 34 is located on the outer surface of wall 18 and inwardly of the passage defined by bores 19 and aligned openings 28 and 29. And, another flat annular valve seat 35 of larger diameter is located on wall 25 in confronting relationship to valve seat 34 and being spaced axially therefrom. Diaphragm valve 31, of resilient plastic material, comprises a flexure member in the form of a spring washer which may be substantially S-shaped in cross-section and comprising two toroidal surface contours which are contiguous and oppositely focused. Alternate forms of flexure members may be used without departing from the invention so long as they are preloaded for controlling both discharge and venting at a predetermined threshold level to reduce sensitivity to changes in environmental conditions when the product container is left inverted with the shipping seal open or removed.

Annular valve surfaces 36 and 37 are defined on opposite sides of the valve respectively adjacent the inner and outer peripheries thereof. In the normally closed position of the valve shown in FIG. 1, its valve surfaces 36 and 37 are respectively spring biased against both valve seats 34 and 35. The spring washer is designed such that its valve surfaces are normally spaced apart axially in a relaxed position of the valve a greater distance than that shown in FIG. 1. The spring washer is therefore shown in FIG. 1 in a compressed condition as effected by lid 13 when snap-fitted in place over the closure cap. The spring washer is attached to neither the lid nor the cap but is loosely sandwiched between the two members which apply axially opposing forces in a compressed direction acting at the inner diameter and at the outer diameter of the valve. The valve member is therefore under axial compression preload as required for a specific threshold for a valve opening pressure level either in the discharge or vent modes. Thus, the bottle when inverted may be left with the central rotary spigot shipping and storage seal in the open position without leaking product from the container.

And, the outer diameter of the spring washer is slightly less than the outermost diameter of its associated valve seat 35, while the inner diameter of the spring washer is slightly greater than the innermost diameter of its associated valve seat 34, so as to define valve clearances 38 and 39 respectively with sleeve 21 and with the adjacent section of wall 25 thereby avoiding any interference during flexing of the valve into its FIG. 2 positions shown at opposite sides of the centerline. And, diaphragm valve 31 includes an annular rib 41 lying substantially along the tangential circular line defined between the oppositely curved portions of the valve for maintaining the overall substantially conical shape of the valve and for stabilizing the seating of the respective valve surfaces as one or the other of them is moved into the open positions shown at opposite sides of the centerline of FIG. 2.

In a non-use condition of shipment or storage, openings 28 and 29 are in a fully misaligned condition as effected upon relative rotation of the lid and cap for essentially closing center discharge port 30. The cap and lid are then relatively rotated to align openings 28 and 29, as shown in FIG. 3, in readiness for a dispensing operation. Thus, as pressure is applied to deformable container or squeeze bottle, as by means of a manual squeeze stroke, such pressure is transmitted to the flowable product to be dispensed from the container as well as to the air therewithin, so that the pressure within the bottle in excess of atmospheric will force product through bores 19 for unseating valve surface 36 away from its corresponding valve seat 34, as shown in the right half of FIG. 2, to permit discharge of product through the open discharge passage. It will be manifest that discharge through the open passage will take place each time the container is compressed as by manual squeezing. Between squeeze strokes, when the pressure is released and the container is permitted to reexpand, the reexpansion tendency will produce a sub-atmospheric pressure within the container interior so that the atmospheric pressure acting against the outer surface of the diaphragm valve will reseat valve surface 36 against valve seat 34 and will unseat valve surface 37 from its corresponding valve seat 35, shown in the left half of FIG. 2, to permit air freely to enter the container through the same passage that product had been discharge but in an opposite direction.

Figure 4:
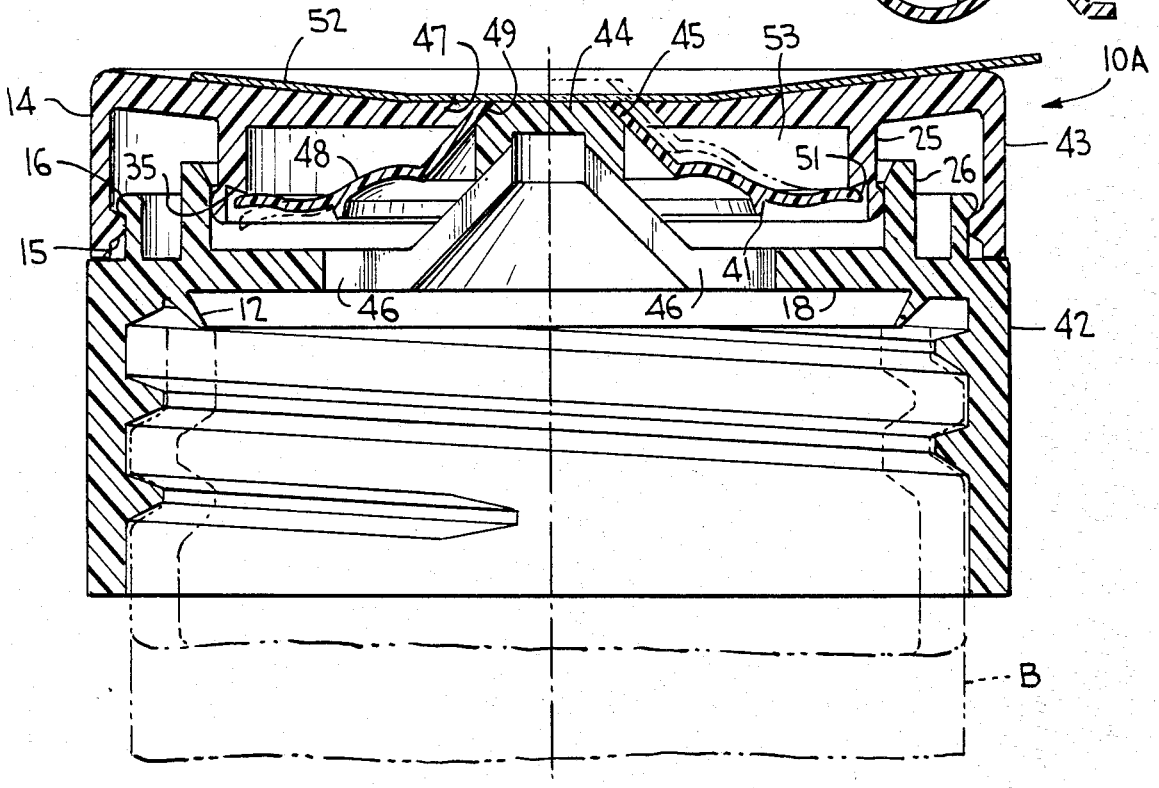
FIG. 4 is a vertical sectional view taken through the dispensing fitment according to another embodiment of the invention showing the valve in phantom outline in a discharge open position to the right of the centerline and in phantom outline in a vent open position to the left of the centerline.

A second embodiment of the dispensing fitment according to the invention is generally designated 10A in FIG. 4 and includes a closure cap 42 and lid 43 engagement essentially the same as that shown in FIG. 1 except for the type of shipping and storage seal provided. Similar parts are therefore designated by the same reference numerals.

Wall 18 of cap 42 is formed with a centrally projecting valve member 44 having a conical or other suitably shaped outer end 45 forming a valve seat. The base of the valve member has a plurality of bores 46 formed therein of rectangular or other suitable shapes. These bores are in communication with the interior of the bottle and establish, together with a central oversized opening 47 provided in lid 43, a fluid passage through which product is dispensed from the container and by means of which the interior of the container is vented during manual manipulation of the squeeze bottle, similarly as in FIG. 1. A diaphragm valve 48 extends across this combined discharge and vent passage for normally closing the passage upon equalization of pressure on opposite sides of the valve, as shown in FIG. 4. Valve 48, which is constructed and functions similarly to that of valve 31, comprises a flexure member in the form of a spring washer which is preloaded for both discharge and venting, and is loosely disposed between the cap and the lid under axially opposing forces in a direction acting at the inner diameter and outer diameter of the valve. Annular valve surfaces 49, 51 are defined on opposite sides of the valve respectively adjacent the inner and outer peripheries, and are respectively seated on the dispense and vent valve seats 45 and 35 of the lid and cap members in the FIG. 1 position. When seated at 45, the valve extends at least beyond the inner edge of central opening 47.

An adhesive seal tab 52 or the like covers opening 47 for sealing the fluid passage in a non-use condition of shipping and storage. Upon manual removal of the tab, as by peeling it away from lid 43, the fitment is ready for use. Opening 47 is sized to define an annular gap around the valve in a dispensing position in which the valve is seated against seat 45. Application of squeeze pressure to the bottle forces product through opening 47 as valve surface 49 unseats and outwardly projects to its phantom outline position (with tab 52, of course, removed) shown to the right in FIG. 4. Thus, the central projection of the valve diaphragm containing the discharge port extends through at least an inner edge of opening 47 at all times so that in use in other than a vertical position, any dribble from the opening and closing of the valve, or from a too modest actuation squeeze, will be cut off at valve seat 44 externally of opening 47 in the lid. This will ensure that no product can enter vent chamber 53 where it could dry and cause disfunction or malfunction of the diaphragm valve. Also, the central opening is purged of any product by the valve during discharge closing.

Between squeeze strokes, the bottle reexpands, creates a negative pressure and closes the discharge valve, after which, the negative pressure unseats the valve as its surface 51 moves inwardly as shown to the left in FIG. 4 in phantom outline.

Figure 5:
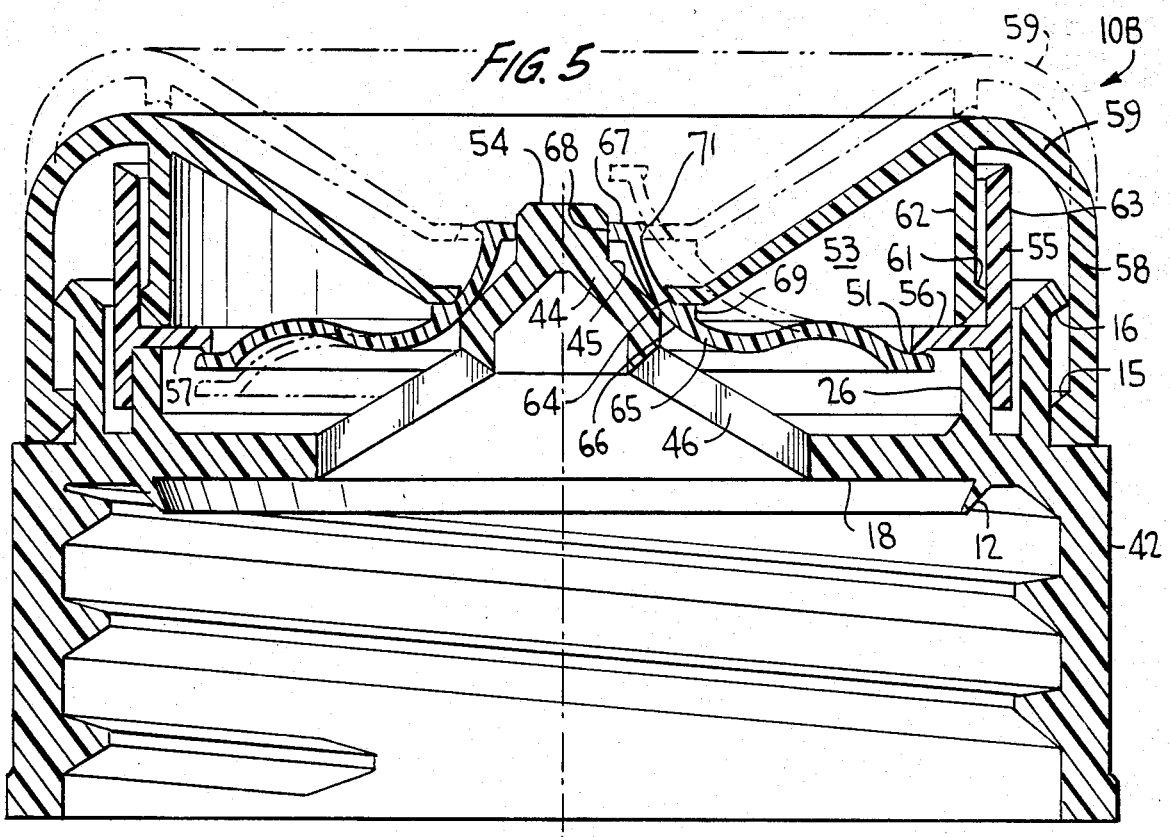
FIG. 5 is a vertical sectional view taken through the dispensing fitment according to a further embodiment of the invention showing the valve in phantom outline in a discharge open position to the right of the centerline and in phantom outline in a vent open position to the left of the centerline.

In still another embodiment of the invention, fitment 10B shown in FIG. 5 is similar to fitment 10A except that it includes a shipping seal which locks the valve down during period of non-use. A central button 54, which may be circular or some other suitable shape, extends outwardly of conical valve seat 45 which is of a slightly larger extent in an axial direction as compared to the conical valve seat of FIG. 4. A ring member 55 is press-fitted around upstanding wall 26 and includes an inwardly extending annular flange 56 defining a vent valve seat 57 on its underside. A lid 58 is similar to lid 43 except that it has an annular crown 59 to facilitate axial movement relative to cap 42 in a fluid tight manner as bead 61 on depending wall 62 sealingly engages upstanding wall 63 of member 55. Of course, member 55 may be made integral with the closure cap in keeping with the invention. And, cooperating ribs 15 and 16 are axially spaced apart in the lid lock-down position, and define limit stops when the lid is shifted outwardly to its dashed outline position of FIG. 5.

The lid has a central opening 64 through which a diaphragm valve 65 extends in the both lock-down and in the discharge positions of the lid shown respectively in solid and in dashed outline in FIG. 5. In the lock-down position, the wall of opening 64 bears against the outer side of the valve and presses an inner surface 66 of the valve against seat 45 as shown. The outer end of the valve has an inwardly extending annular flange 67 defining a central opening 68 which corresponds to the shape of and may be slightly larger than button 54. Vent valve surface 51 is defined at the opposite end of the valve. An annular rib 69 is provided on the outer surface of the valve at a location beneath the line of tangency between seat 45 and surface 66, and defines a bearing shoulder for the lid in the valve lock-down position. Bearing pressure is thus confined to seat 45 and is not transmitted therebelow in a manner to weaken the closed vent valve.

The axial spacing between ribs 15 and 16 is selected such that, in the outwardly shifted position of the lid in readiness for dispensing the outer surface of flange 67, which forms a central spout, projects slightly outwardly of the outer edge of central opening 64. Thus, as in FIG. 4, the diaphragm containing the discharge port extends beyond at least an inner edge of the lid opening in a dispensing position of the lid, and in FIG. 5 in a lid lock-down position, so that any drip, dribble or unduly slow bottle squeeze will not cause product to run back into vent cavity 53 under the lid. This can be enhanced by the provision of a small bead or flange 71 around flange 67 which functions as a dripless spout of known design. Thus, if the container is tipped sufficiently for product to flow against the inside of the lid, the central spout will project through the central lid opening far enough to keep any product effluent from flowing into the vent cavity. The package can therefore be stored on its side, and even dispensed in that attitude without admitting product into the vent cavity where product accumulation would cause clogging of the valve diaphragm.

In operation, lid 58 is manually pulled outwardly to its dashed outline position in readiness for dispensing. Of course, the lid may instead be threaded on to the closure cap in some suitable manner to permit relative axial movement between its dashed and solid outline positions. In such arrangement, the cap may be snap-fitted into or on to (FIG. 6) the neck of the supply container so as to avoid any unthreading of the cap upon unthreading the lid. And, it should be pointed out that dispense valve surface 66 is normally seated against its valve seat 45 in a valve closed position after the lid is shifted outwardly. Button 54 purges and plugs discharge opening 68 in flange 67, preventing any drying of accumulated product in the discharge area. The valve is otherwise preloaded to function similarly as valve 48. Thus, surface 66 is unseated (seen to the right in FIG. 5) during the dispense mode, and surface 51 unseated (seen to the left in (FIG. 5) during the vent mode, as the bottle is manually squeezed and released. Any clogging of the valve beneath the lid is substantially avoided as the central valve spout projects into the surrounding opening in the lid when in an unlocked position. And, when the discharge passage closes when pressure on the bottle is released and is permitted to reexpand, the discharge opening through the valve is purged of any product and button 54 is wiped clean by flange 67 as it returns to its solid outline position.

Figure 6:
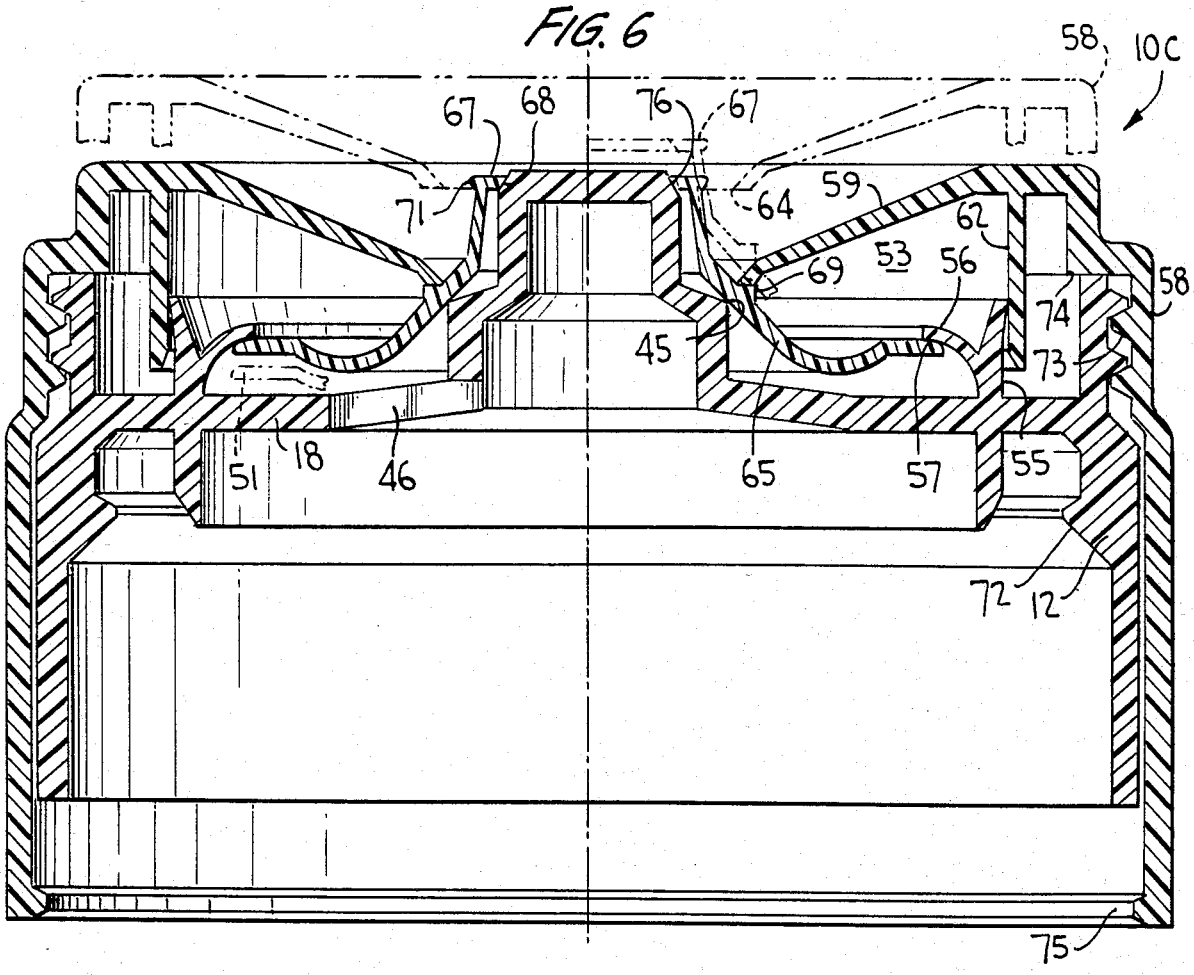
FIG. 6 is a view similar to FIG. 5 of a slightly modified dispensing fitment.

Another dispensing fitment 10C is shown in FIG. 6 of similar construction to that of fitment 10B. However, the closure cap is instead provided with a snap bead 72 for snap-fit engagement with the rim of a squeeze bottle (not shown). Lid 58 completely envelops the cap, is in threaded engagement therewith as at 73 and has an annular shoulder 74 overlying the cap defining an abutment or stop which facilitates assembly of the cap firmly onto the bottle as the cap and lid are pressed down thereover. The closed cap is thus sealed to the bottle and the lid may be easily unthreaded when shifted outwardly to permit dispensing. Of course, other interface engagements between the cap and lid may be provided to facilitate driving the cap onto the container while permitting axial shifting of the lid between its lock-down and dispense positions, respectively shown in solid and dashed outline in FIG. 6.

An annular stop shoulder 75 on the lid limits the extent of outward shifting movement to a position whereby central opening 64 of the lid is disposed slightly inwardly of the valve diaphragm containing discharge port 68. The discharge spout defined by flange 67 thus projects beyond the inner edge of opening 64 in the outwardly shifted position of the lid, in both the discharge valve closed position (solid outline) and in the discharge valve open position (dashed outline). Valve 65 is self spring loaded to return a rest position with both the discharge and vent valves closed under the residual preload force at 57 and 45 (or at 76). Discharge valve seats may be defined at 45 and/or 76 without departing from the invention.

The added load at 45, applied by the lid crown 59 seated against rib 69 in the lock-down (solid outline) position of FIG. 6, prevents opening the discharge passage inadvertently. And, ring member 55 is integrally formed with the closure cap, depending wall 62 on the lid sealingly engaging therewith between inwardly and outwardly shifted positions of the lid.

The operation is essentially the same as that of fitment 10B. And, when the package is used with the central axis of the cap in an attitude other than vertical, any product which would be left on an external edge or surface of the discharge port at the end of the dispense mode must be prevented from dripping or draining into vent chamber 53 where it could cause clogging of dried product and interfere with venting. This is accomplished by arranging, as in FIG. 5, the valve discharge port as lying in its inwardmost position outwardly of the outermost position of opening 64 in the lid which surrounds it. Thus, it is assured that at the discharge port 68, any drop or dribble of product, or unduly slow bottle squeeze, will not cause product to run back into the vent cavity of the lid. And, as in FIG. 5, this may be enhanced by the provision of a lip or bead 71 around the outside of flange 67 which functions similar to that of a dripless spout.

Examples of several valve-half shapes 48*a* to 48*f* are shown in FIGS. 7A to 7F. Diaphragm valves 31 and 65 may be correspondingly shaped, and still other shapes are made possible without departing from the invention.

From the foregoing, it can be seen that the valving functions in accordance with each of the disclosed dispensing fitment embodiments are separate and unidirectional during both the dispense mode and the vent mode, permitting valve opening in only one direction and positively closing the valve against its corresponding valve seat in the opposing direction, similar to that of a one-way check valve. Each diaphragm valve is in the form of a spring washer under preload which is not attached to either the lid or the closure cap, has no fit requirements as there are not attachments, and is not stretched in any direction, but is loosely sandwiched between the lid and the closure cap, or between the cap and a ring member thereon, which apply opposing forces in the axial direction acting at the inner diameter, or adjacent thereto, and at the outer diameter of the valve member. Both the inner diameter and outer diameter of the diaphragm valve are therefore free of any radial fit to either the lid or the closure cap, leaving only axial compression at the valve rim and at the center hole of the valve or at a valve portion adjacent thereto, as the forces acting on the valve before use. Thus, the valve functions by pure flexure, and can accommodate different amounts of preload for different applications. Since there is no radial stress on the valve, axial loads applied at the inner diameter and outer diameter are assimilated by elastic deformation of the two toroidal surface contours which are continuous and oppositely focused. This shape is important in permitting a rolling type of flexure in response to pressure differentials across the valve member, in one direction at the outer rim, and in the opposite direction at its central opening. This valve function is therefore independent of any center post or other central member, depending only on a suitable valve seat. The entire section of both the lid and the closure cap relate exclusively to a separate rotary valve in one embodiment for shipping and storage purposes and do not cooperate with the diaphragm valve in any manner. In other embodiments, the lid is shiftable between lock-down and fitment use positions. And, by extending the discharge port end of the valve into the surrounding lid opening, product is prevented from entering the vent chamber under the lid. In accordance with another feature of the invention, when the dispense mode is complete, the discharge port automatically closes over a valve button to purge the port to prevent plugging with dried product and to reseal the discharge port against inadvertent discharge.

Otherwise, an oversized opening in the lid into which the valve extends may be sealed closed for shipping and storage purposes by a manually removable adhesive tab.

Obviously, many modifications and variations of the present invention are made possible in the light of the above teachings. For example, central port 30 in the lid could be closed, and one or more discharge ports could be formed in the outer wall of the lid for effecting an off-center discharge flow. And, bores 19 in wall 18 could therefore be eliminated, and a central bore could instead be provided in wall 18. Such would require an inverted diaphragm valve having its inner diameter located downstream of its outer diameter with the valve surfaces at its inner and outer peripheries respectively in seating engagement with flat annular seats on the lid and on the closure cap, all without departing from the scope of the invention. It is therefore to be understood that within the scope of the appended claims the invention may be practiced otherwise than as specifically described.

What is claimed is:

1. A manually operable dispensing fitment for fluid tight engagement with the outlet opening of a squeeze bottom containing a product to be dispensed:

the fitment comprising a combined discharge and vent fluid passage establishing communication between the atmosphere and the interior of the squeeze bottle;

the fitment defining a pair of annular valve seats of different diameters;

and the fitment including an annular, resilient and preloaded diaphragm valve extending across the fluid passage, the valve being loosely fitted to the fitment and bearing against said valve seats which solely apply opposing forces acting against the valve in an axial direction of the fitment for normally closing the passage upon equalization of pressure on opposite sides of the valve, the valve being deformed by flexure only and without stretching into a discharge open position in which the valve is axially unseated unidirectionally from one of the valve seats when the pressure within the bottle exceeds atmospheric pressure, and the valve being deformed into a vent open position in which the valve is axially unseated unidirectionally from the other of the valve seats when the pressure within the bottle is reduced below atmospheric pressure.

2. The fitment according to claim 1, including a closure cap having said one valve seat formed thereon, a lid in engagement with said cap, one of said lid and said closure having said other valve seat formed thereon, and said passage being defined by bores located in said cap and in said lid.

3. The fitment according to claim 2, wherein said cap and said lid engage for relative rotary movement, sleeves on said cap and said lid extending toward one another in a telescoping relationship, said bores including cutouts in said sleeves capable of being aligned and misaligned upon the relative rotary movement for respectively opening and closing said passage.

4. The fitment according to claim 2, wherein the bore in said lid is coaxial with said one valve seat and is oversized relative thereto with said valve lying therein for limiting the extent of the discharge open position, a vent chamber being defined between said lid and said valve in communication with the bore in said lid, whereby any product is prevented by the valve from entering the vent chamber during product discharge, and the opening in the lid is purged of any product by the valve during discharge closing.

5. The fitment according to claim 4, wherein said lid has said other valve seat formed thereon.

6. The fitment according to claim 4 or 5, wherein a removable seal tab covers the opening in the lid in a non-use condition of shipment and storage.

7. The fitment according to claim 4, wherein said lid is axially movable relative to said cap into a shipping/storage position in which said lid bears against said valve.

8. The fitment according to claim 4 or 7, wherein said cap has said other valve seat formed thereon.

9. The fitment according to claims 1, 2, 3, 4 or 5, wherein said diaphragm valve comprises a flexure member in the form of a spring washer comprising two torodial surface contours which are contiguous and oppositely focused, said flexure member having valve surfaces on opposite sides, said valve surfaces being respectively engageable with said valve seats.

10. A dispensing fitment for a squeeze bottle comprising:

a closure cap for fluid tight engagement with the neck of the bottle;

a lid in engagement with said cap;

means defining a combined product discharge and vent passage in said cap and in said lid extending from the interior of said cap and exteriorly of said lid;

a pair of annular valve seats of different diameters respectively located inwardly and outwardly of said passage; and a resilient, preloaded annular valve member extending across said passage, said member being unattached to either said lid or said cap and bearing against said valve seats which solely apply opposing forces acting against the valve in an axial direction of said cap and said lid in a valve closing position during equalization of pressure on opposite sides thereof, said member being unseated from only one of said valve seats in a product discharge open position upon an increase in pressure at an inner side thereof which exceeds atmospheric pressure, and said member being unseated from only the other of said valve seats in a vent open position upon a decrease in pressure at said inner side thereof below atmospheric pressure.

11. The fitment according to claim 10, wherein said valve seats are spaced apart in an axial direction of said cap, said one valve seat being located on said cap, and one of said cap and said lid having said other valve seat located thereon.

12. The fitment according to claim 10, wherein said cap and said lid include telescoping sleeves extending toward one another, said passage comprising openings in said cap and in said lid, said openings including cutouts in said sleeves, and said lid engaging said cap for relative rotary movement for aligning and misaligning said cutouts to respectively open and close said passage upon said relative rotary movement.

13. The fitment according to claim 11, wherein said passage comprises at least one opening in said cap and a central opening in said lid, said valve extending into said central opening at least beyond an inner edge thereof when in said valve closing position, said central opening being sized to define an annular gap around said valve in a dispensing position, said valve, when unseated, projecting into said central opening beyond said inner edge thereof in said dispensing position, and a vent chamber defined between said lid and said valve, whereby any product is prevented in both said valve closing position and in said dispensing position from entering said vent chamber, and said central opening is purged of any product by said valve during discharge closing.

14. The fitment according to claim 13, wherein said lid has said other valve seat located thereon.

15. The fitment according to claim 13, wherein said cap has said other valve seat located thereon.

16. The fitment according to claim 15, wherein said lid is axially movable relative to said cap between said dispensing position and a valve lock-down, non-use position of shipping and storage, said lid bearing against said valve as seated on said one valve seat in said non-use position.

17. The fitment according to claim 10 or 13, wherein said member comprises a spring washer having a pair of toroidal surface contours which are contiguous and oppositely focused, said washer having annular valve surfaces on said inner side and on an outer side thereof, said valve surfaces engageable with said valve seats.

18. The fitment according to claim 15, wherein cooperating limit stops are provided on said lid and cap for limiting relative movement of said lid to said dispensing position.

* * * * *